US005531063A

United States Patent [19]

Sawhney et al.

[11] Patent Number: 5,531,063

[45] Date of Patent: Jul. 2, 1996

[54] DEVICE FOR FORMING CORE/WRAP YARN

[75] Inventors: A. Paul S. Sawhney, Metairie; Craig L. Folk, New Orleans, both of La.

[73] Assignee: The United States of America as represented by the Secretary of the Department of Agriculture, Washington, D.C.

[21] Appl. No.: 195,429

[22] Filed: Feb. 14, 1994

Related U.S. Application Data

[63] Continuation-in-part of Ser. No. 22,207, Feb. 25, 1993, abandoned, which is a continuation-in-part of Ser. No. 603,504, Oct. 26, 1990, abandoned, which is a continuation-in-part of Ser. No. 366,702, Jun. 15, 1989, Pat. No. 4,976,096.

[51] Int. Cl.[6] ..... D02G 3/36; D01H 1/00; D01H 1/42

[52] U.S. Cl. ..... 57/12; 57/279; 57/352; 19/244; 19/288

[58] Field of Search ..... 57/75, 352, 315, 57/5, 12, 279, 280; 19/288, 289, 291, 257, 258, 292

[56] References Cited

U.S. PATENT DOCUMENTS

| | | | |
|---|---|---|---|
| 1,586,605 | 6/1926 | Butler | 19/292 |
| 2,795,925 | 6/1957 | Parker et al. | 57/75 |
| 3,350,867 | 11/1967 | Morrison et al. | 57/12 |
| 3,599,416 | 8/1971 | Reuter et al. | 57/352 X |
| 4,584,830 | 4/1986 | Faure et al. | 57/5 X |
| 4,922,701 | 5/1990 | Sawhney et al. | 57/315 X |
| 4,976,096 | 12/1990 | Sawhney et al. | 57/12 |
| 5,048,157 | 9/1991 | Wehrli | 19/258 X |
| 5,119,996 | 6/1992 | Stahlecker | 57/279 X |

*Primary Examiner*—Michael R. Mansen
*Attorney, Agent, or Firm*—Kenyon & Kenyon

[57] ABSTRACT

A device for forming core/wrap yarn is provided in which a core strand and one or more wrap strands are passed from the nip of a pair of rollers to a stationary support surface which is outwardly, downwardly curved and which includes an open channel therein; wherein the core strand is passed through the channel from the nip and the wrap rovings are passed from the nip to converge upon and wrap around the core strand in the channel to form wrapped yarn; wherein the support surface may be moved from its operative position to a second position to allow a second mode of operation absent the support surface and wherein the support surface is tapered from the outer edges toward the channel.

11 Claims, 7 Drawing Sheets

DEVICE FOR FORMING CORE/WRAP YARN

PRIOR APPLICATIONS

This application of CIP of application Ser. No. 022,207, filed Feb. 25, 1993, now abandoned which is a CIP of Ser. No. 07/603,504, filed Oct. 26, 1990, now abandoned which in turn is a CIP of application Ser. No. 366,702 filed Jun. 15, 1989 which has issued as U.S. Pat. No. 4,976,096.

FIELD OF THE INVENTION

The present invention relates to the production of textile yarn and more specifically relates to the production of core/wrap yarn.

PRIOR ART

It is known that core/wrap yarn or wrapped core yarns may be produced by wrapping a fibrous sheath around a continuous filament core. Alternatively, a continuous filament may be wrapped around a staple fiber core. Still further, both the core and wrapping or sheathing may consist of staple fibrous materials, or both may be continuous filament materials. To date, in the production of ring-spun core/wrap yarn with staple fibrous materials, the wrapping step has been carried out prior to ring spinning, i.e., during the formation of roving from sliver, thereby producing a core/wrap roving, which subsequently must be spun into yarn in a ring spinning step; or during the drawing process, thereby producing a concentrically cored sliver, which subsequently must be roved into roving and spun into yarn in a ring spinning step. To date, no practical system has been developed to directly produce core/wrap yarn in a ring-spinning frame from a plurality of unwrapped roving strands.

The following definitions apply to several terms that appear in the specification and claims:

Carding—the use of a carding machine to align, clean, and straighten fibers, and to remove very short fibers as well as fine trash, to produce sliver.

Drawing—the making parallel and straightening of sliver fibers to improve the uniformity of linear density, usually accomplished in 1, 2, or 3 passages through drawing equipment known as a draw frame or drafting frame. In each passage through a draw frame, several sliver strands are combined into a single sliver strand.

Drafting—the process whereby a fiber bundle such as a sliver or roving is extended in length in order to reduce the linear density of the bundle and to increase the parallelization of the fibers. Various forms of drafting are employed in carding, drawing, roving, and ring-spinning.

Sliver—the product produced by carding or drawing, i.e., a very coarse strand of fibers having essentially no twist.

Roving process—conversion of sliver by drafting into a thinner strand called a roving in which a small amount of twist (normally 1–2 turns per inch) is imparted to the strand. This step is performed only in conjunction with subsequent ring spinning. No other type of spinning presently requires roving prior to spinning.

Ring-spinning process—As used herein, an operation for converting roving into yarn by drafting a roving and imparting twist through use of a ring and a moving traveler on a ring-spinning frame. A small percentage of ring-spinning machines do not require prior formation of roving, but instead convert sliver directly into yarn except that the sliver is passed through additional drafting apparatus on the ring frame immediately prior to passage through the ordinary draft rolls/aprons associated with ring spinning.

SUMMARY

A new system is provided for producing a new product by directly producing core/wrap yarn from a plurality of unwrapped rovings. Broadly, the process comprises feeding a core strand and at least one separate wrap strand from the nip of a pair of draft rollers directly to a stationary strand support immediately downstream from the nip. The wrap strand(s) converge with the core strand in an open channel on the support means, and wrap around the core strand, so as to form core/wrap yarn.

The product achieves a degree of wrap coverage never before attainable. Over 99% of the core is covered, i.e., less than 1% of the core is uncovered, whereas prior art core/wrap yarns achieve no better than 90% coverage, i.e., 10% of the core is uncovered.

The support means provides an outwardly, downwardly curved support surface for the core and wrap strands. The curved surface includes an open channel which extends along the outwardly, downwardly curved support surface. The convergence and wrapping of the strands takes place in the channel.

The wrapped yarn then is passed to an ordinary ring traveler and wind-up spindle of a ring-spinning assembly. In this manner, unwrapped roving is converted to core/wrap yarn in a continuous process.

It is an object of the present invention to produce a new core/wrap yarn having the following advantages and distinctions over previous yarn products:

It practically is totally covered compared to much lesser covering percentage of previous core/wrap products.

The core fibers are oriented along the length of the yarn and are positioned in the middle of the cross-section.

Due to unique interlacing of the cover fibers (effected by two strands of drafted rovings, one on each side of the core material), the yarn sheath does not strip from the core at all. Furthermore, the strip resistance is equally good in both directions along the yarn.

The staple-core/cotton-wrap yarn produced with a high tenacity staple fiber is significantly stronger than an equivalent 100% cotton yarn or an equivalent, regular intimate-blend yarn.

The device is capable of producing relatively fine yarns (e.g., yarns of up to 40/1 cotton count or finer).

Both the core as well as cover fibers contribute to the mechanical properties of the yarn produced by the present system; and mechanical properties, such as tear strength, tensile strength and abrasion resistance, of the fabrics produced from such yarns have exhibited significant improvements.

The staple-core-spun yarns of the present invention are economical compared to existing filament-core yarns, mainly because of the lower cost of the staple fibers, compared to filament yarns.

Inferior quality cotton, wool, manmade fiber, or any other fiber can be used in the core, and the premium fiber can be utilized in the cover to produce a premium-looking product.

Many types of novelty yarns and fabrics, such as crepe-like, denim-like fabrics, and differential dye effects, can be produced by the spinning technique of the present invention.

It is much easier to piece-up the ends during spinning, when compared to earlier reported spinning techniques.

The staple-core yarns are highly useful for producing textile products where high strength and cotton surface are both desirable and/or critical, such as strong, easy-to-care-for and comfortable apparel of predominantly cotton, certain military fabrics, such as tentage, chambray shirting, work uniforms, strong sewing threads with heat-insulation cotton cover, and strong pill-resistant fabrics.

Other objects and advantages of the present invention will be obvious from the following detailed description, in conjunction with the drawings in which.

Figure 2:
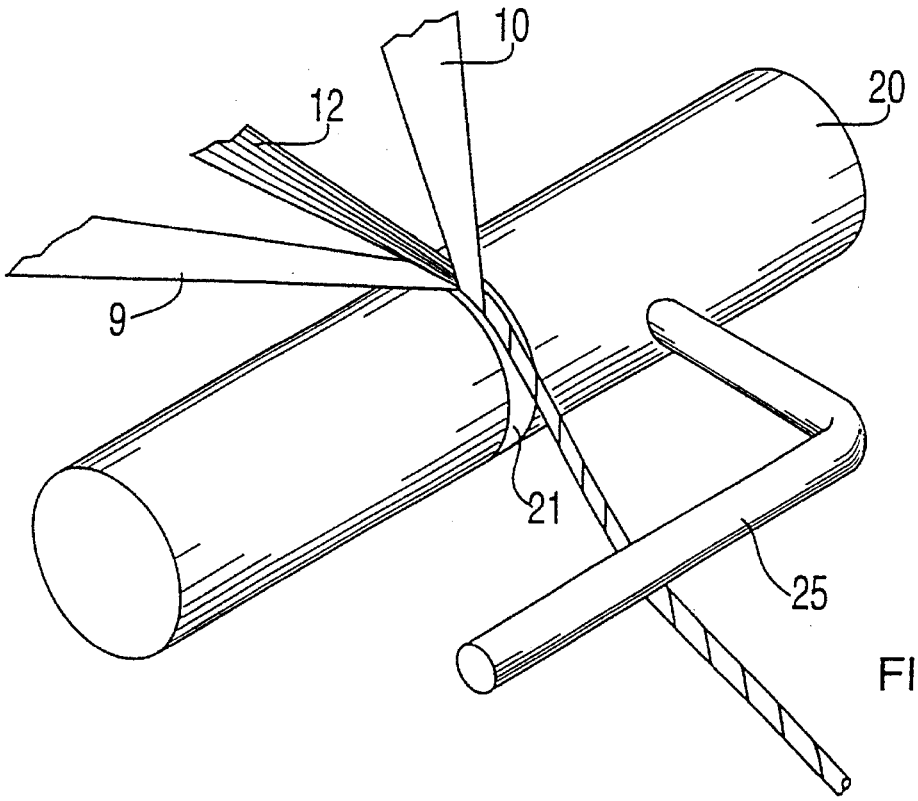
FIG. 2 is a partial perspective view of a bar 20 of FIG. 1.
Figure 2A:
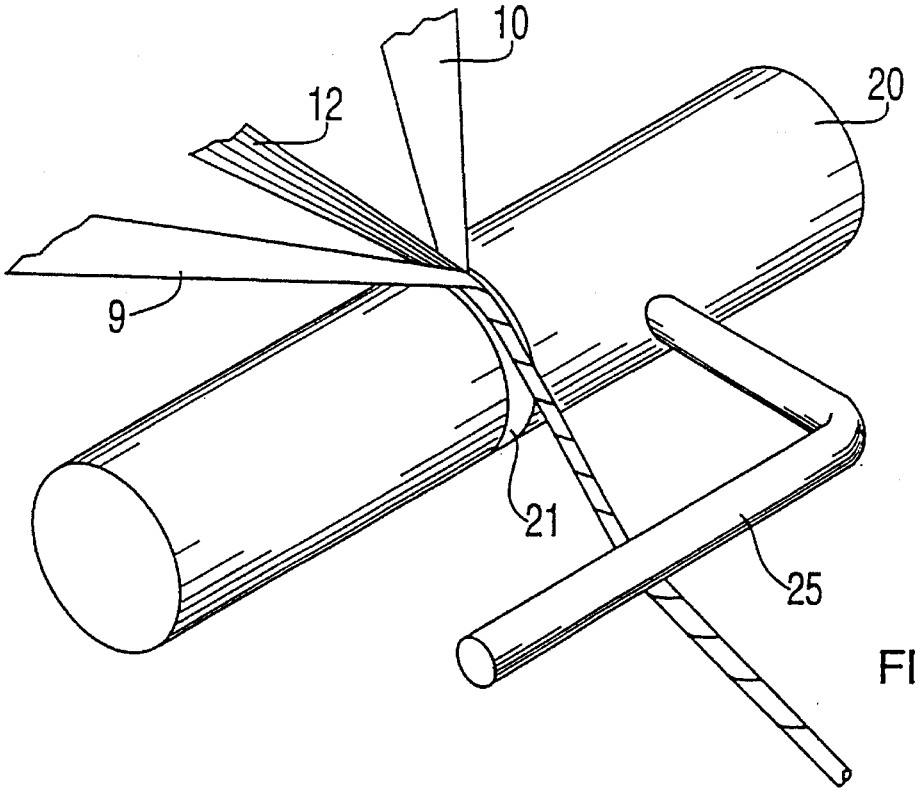

FIG. 2*a* is an alternative embodiment of FIG. 2.

Figure 1:
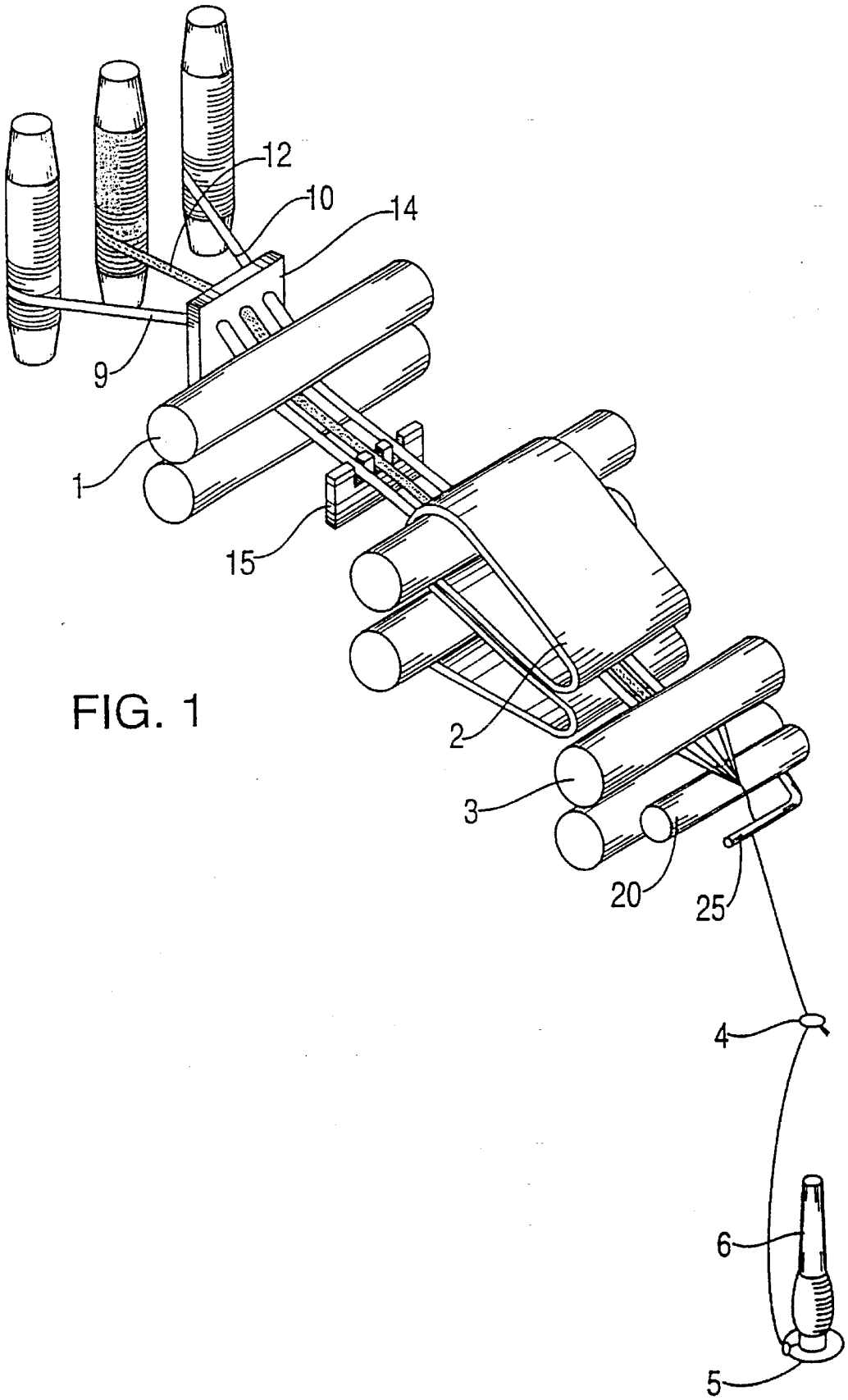
FIG. 1 is a perspective view of the overall system of the present invention.
Figure 3:
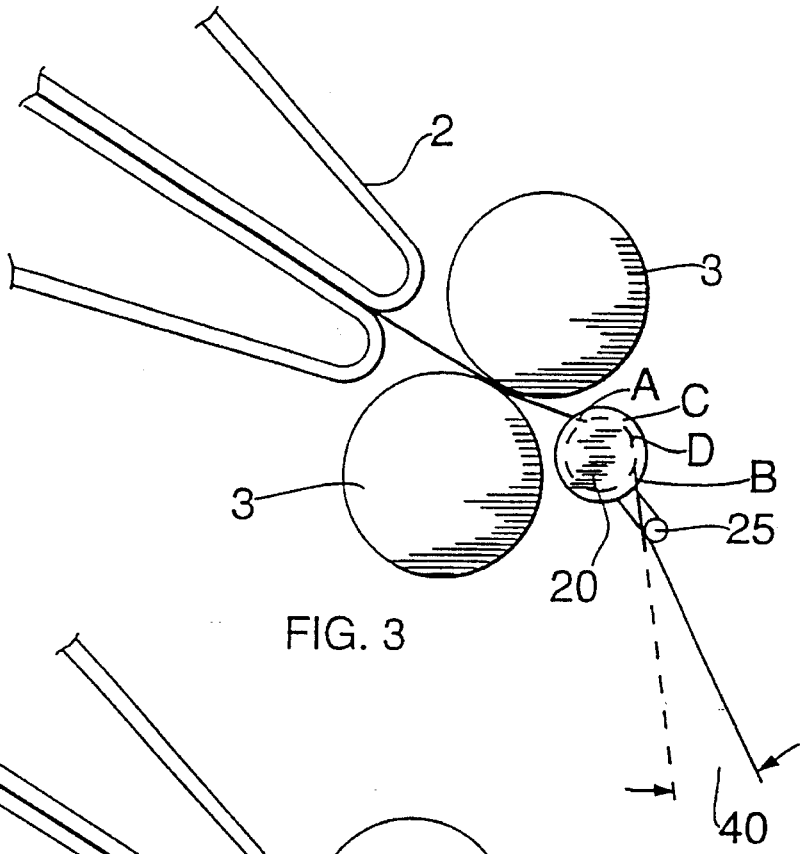

FIG. 3 is a side view of part of the apparatus of FIG. 1.

Figure 3A:
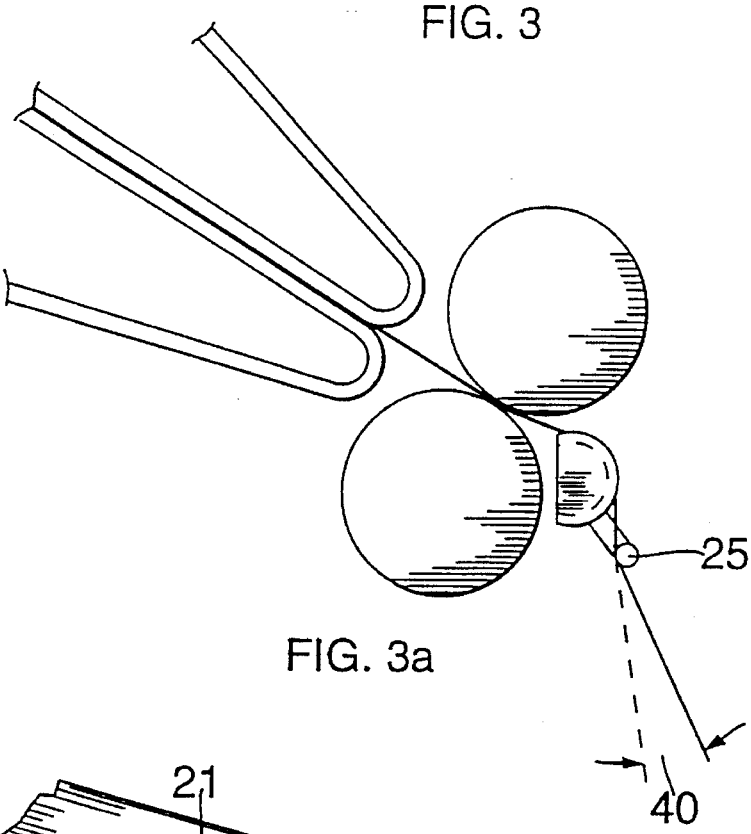

FIG. 3*a* is a side view of an alternative embodiment.

Figure 4:
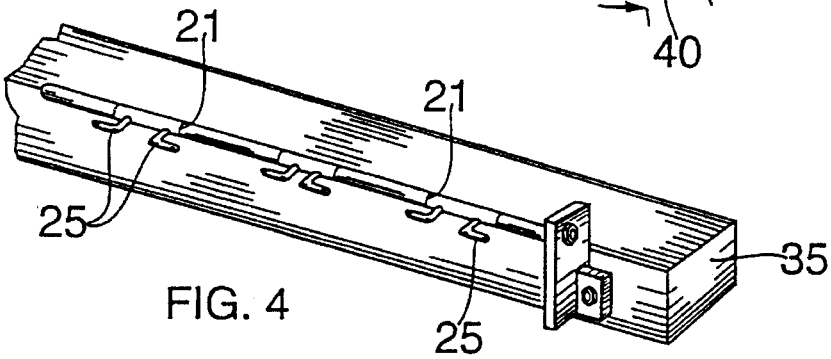

FIG. 4 generally shows the use of bar 20 in conjunction with a plurality of side-by-side spinning systems mounted on the same frame.

Figure 5:
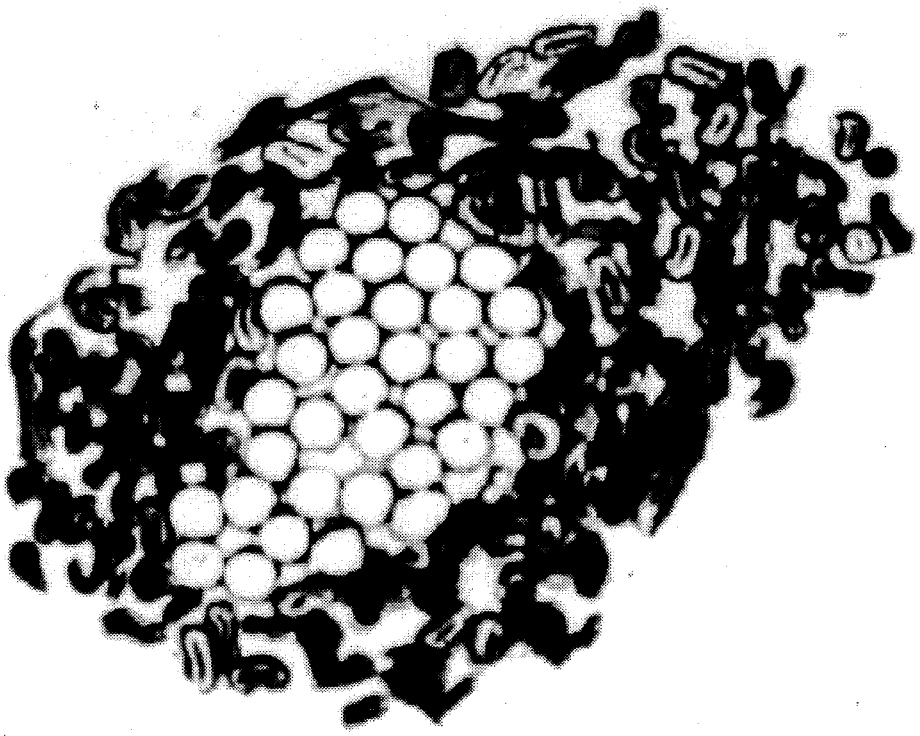

FIG. 5 is a photograph of a cross-section of the product of the present invention.

Figure 6:
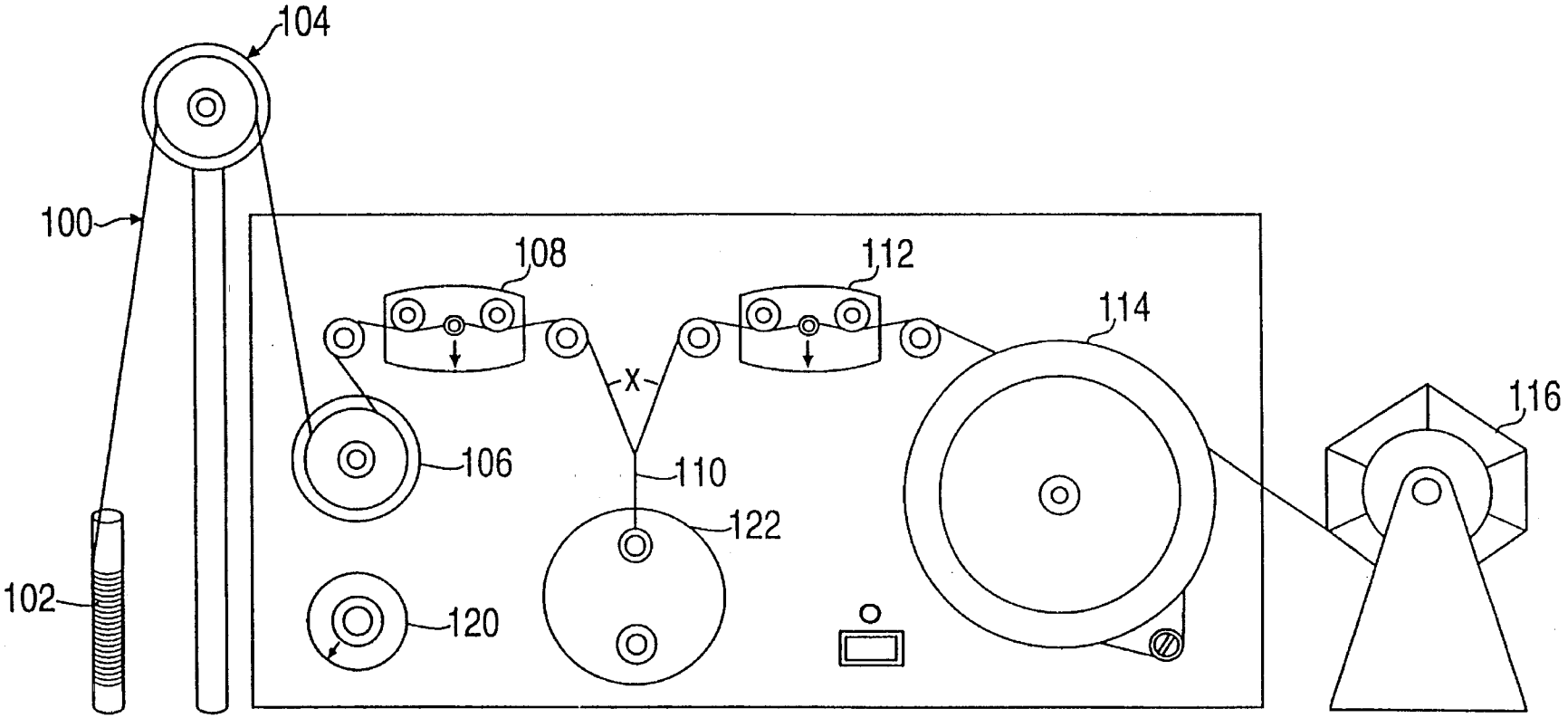

FIG. 6 is a schematic of an apparatus for testing strip resistance of core/wrap yarns.

Figure 7:
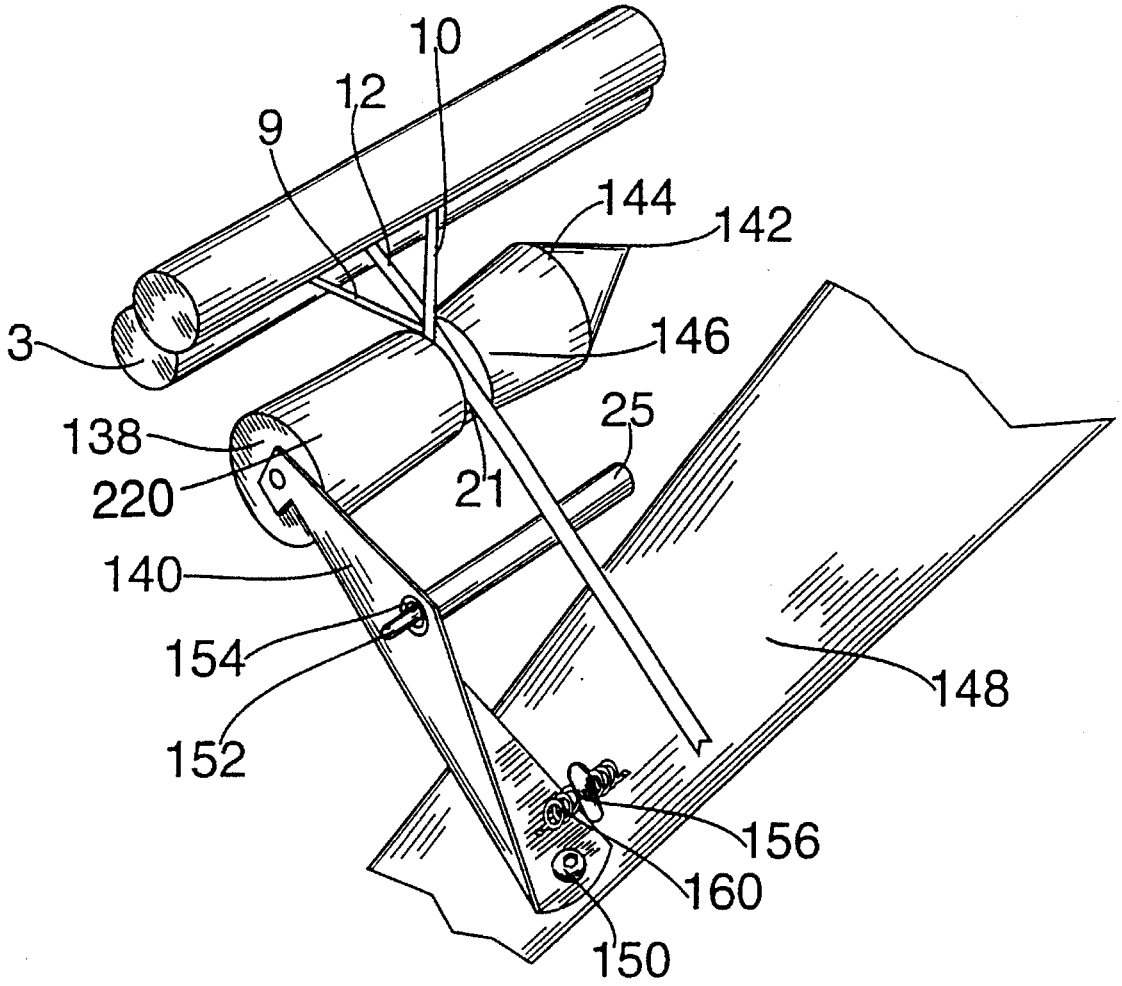

FIG. 7 is a perspective view of a further embodiment of the present invention configured in an operational position.

Figure 8:
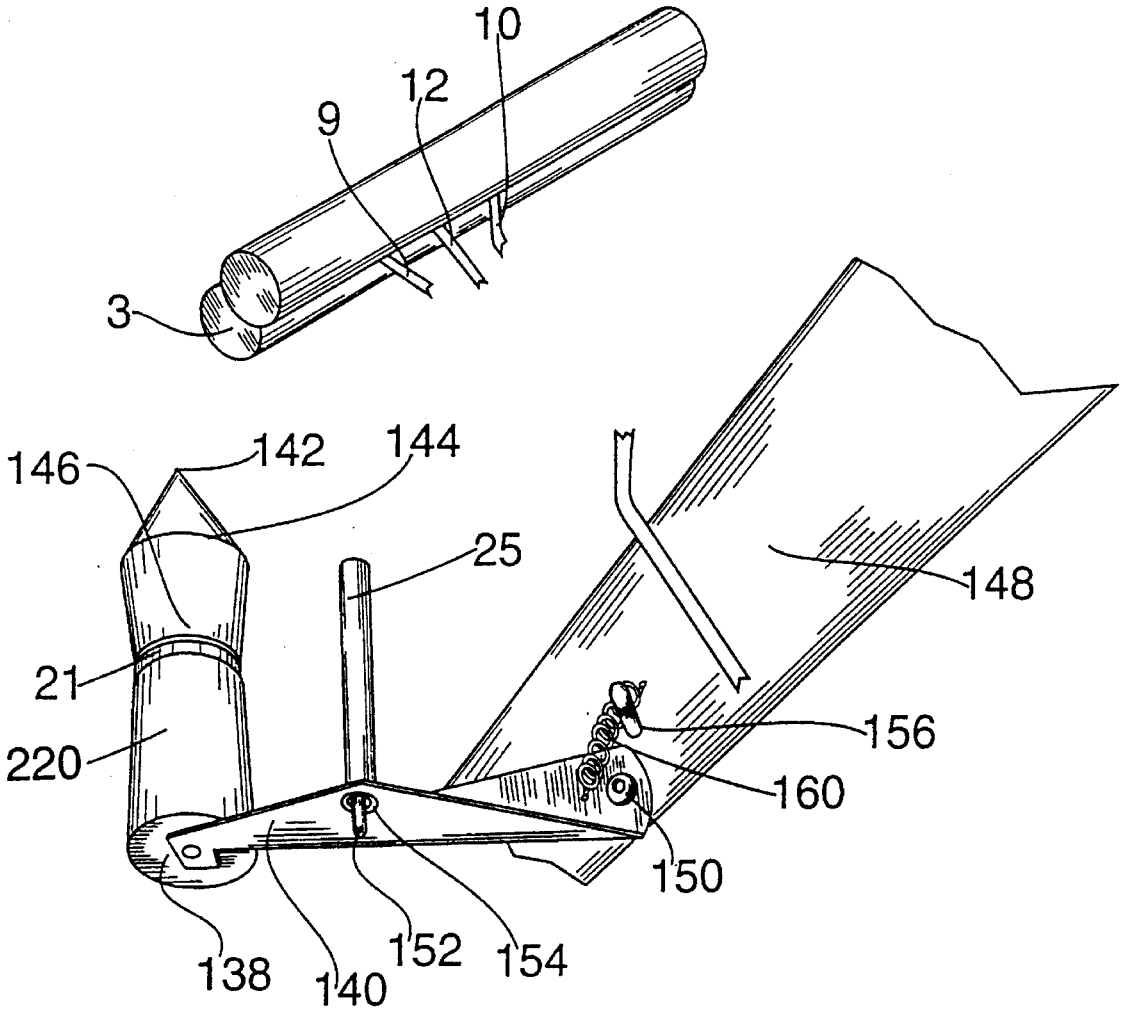

FIG. 8 is a perspective view of the further embodiment of the present invention configured in a second position for piecing-up.

DETAILED DESCRIPTION

Components of ordinary ring spinning equipment may be employed in the practice of the present invention. These are illustrated in FIG. 1 as rear draft rollers 1, drafting aprons 2, front draft rollers 3, pigtail guide 4, ring 5 and yarn bobbin 6. Hereinafter, this combination of elements is referred to as a single spinning system.

In addition, there are three bobbins upstream of rear shaft rollers 1. Two of these bobbins feed wrap roving 9 and 10 such as cotton roving to rear rollers 1, while the other bobbin feeds core roving 12 such as polyester roving thereto.

Starting materials for the practice of the present invention, such as cotton and polyester rovings, may be prepared in a conventional manner.

A conventional roving condenser 14 is disposed between the bobbins are rear rollers 1 in order to maintain a space between rovings. In addition, another condenser 15 is positioned between rollers 1 and aprons 2 so as to provide unconventional spacing between strands that emerge from the nip of front rollers 3. That is, this latter condenser is dimensioned to provide unequal spacing from the core strand to each wrap strand at the point of emergence of the strands from the nip of front rollers 3. In other words, the space between wrap strand 9 and core 12 is not the same as the space between wrap strand 10 and core 12 at the point of emergence of these strands from the nip of the front rollers 3. More specifically, the spacing between strand 9 and 12 is slightly less than the spacing between strands 10 and 12 in the case of a "Z" twist at yarn formation (FIG. 2), and vice-versa in the case of "S" twist (FIG. 2*a*). Generally, the lesser spacing is about 70–80% of the greater spacing between centerlines of respective strands.

Referring to the lesser spacing between wrap and core, this will depend upon the fiber length being processed, and consequently on the size of the spinning equipment (i.e., short-, mid-, or long-staple spinning system). For a conventional cotton (short-staple) spinning system, the lesser space between wrap and core strands may be about 3/32" to 5/32". For long staple fibers such as wool, this dimension may vary from abut 1/4" to 5/8".

Referring again to FIG. 1, disposed between pigtail guide 4 and front rollers 3 is a cylindrically-shaped, hollow or solid bar 20. The bar provides an outwardly, downwardly directed support surface for the core and wrap strands. The bar acts as a support for the strands and as the point at which wrapped yarn formation occurs.

As can be seen in FIG. 2 or 2*a*, a groove 21 is present in bar 20 which constitutes the necessary open channel in the support surface through which the core strand passes, and in which the wrap strands envelop the core strand. Groove 21, which lies in a plane which is perpendicular to the plane of the front roller nip, is positioned such that core strand 12 passes directly from the nip into the groove, while wrap strands 9 and 10 first pass in contact with the surface of bar 20 adjacent groove 21 before entering the groove.

Bar 20 and the wall of groove 21 most preferably are polished at least where these elements directly contact the wrap and core strands.

The diameter of bar 20 depends upon fiber length, especially of the wrap fiber length. For a typical 1.5" long polyester-staple-core and 1" long cotton-wrap fibers, the diameter of the bar may be about 3/8" to 3/4". For a 3" long staple fiber, the bar may be as much as 2" in diameter.

The fibrous strands emerging from the front roller nip are weak due to absence of twist. Only the inter-fiber cohesion and the support of bar 20 keep the materials intact and continuously flowing without breakage or interruption.

The distance between bar 20 and the front roller nip should be such that there is essentially or drafting of the core strand between these two points. Thus, the distance between the yarn wrapping zone on bar 20 and the front roller nip, measured along the core strand, is less than the length of most of the fibers in the core strand. By avoiding drafting, the full yarn tension is maintained in the core strand upstream of bar 20. The loss of this tension otherwise would allow excessive "twist" upstream of bar 20 and would result in barber poling and less than subsequent full coverage of the core strand by the wrap strand.

In addition, the distance of bar 20 from the front roller nip should be such that there is no drafting of the longest fibers (i.e., for cotton, the so-called "2.5% span length" fibers) in the wrap strands, but there is drafting of some of the shorter fibers therein. In other words, the distance along each wrap strand from the point of emergence of each wrap strand at the front roller nip to the yarn formation point on bar 20 is greater than the shortest fiber length therein but about 50–80% of the "staple" length. In the case of cotton-wrap fibers, the distance along the wrap strands measured from front roller nip to yarn formation typically is about 1/2" to 7/8".

Thus, in the practice of the present invention, the fibers, after emerging from the nip of the front rollers, are loose with no twist to hold them together except for the slight twist imparted to the core-strand-fibers during passage from nip to bar. The bar acts as a guide for transportation of fibers from the nip to the yarn formation point on the bar.

With further regard to positioning the bar, its longitudinal axis generally may be approximately equidistant from and parallel to the axes of the two front rollers, as shown in FIG. 3. The exact position should be set to provide the appropriate fiber path, as set forth above, from the nip of the front rolls to the point of contact with the bar, while still allowing clearance between the bar and each of the front rolls. The clearance between the bar and the top front roll should be sufficiently large that even the thickest segments of drafted strands cannot be gripped between these surfaces, which would otherwise have the undesirable effect that the lateral movements of the wrapper fibers would be restricted and the flow of fibers would be interrupted. The clearance between the bar and the bottom front roll should be sufficiently large so that the bar does not interfere with the scavenging of fibers by the spinning system's vacuum system in case of yarn breakage. The use of a bar having a half-circle rather than full circle cross-sectional shape permits the bar to be positioned closer to the nip and bottom roll, as shown in FIG. 3*a*.

Taking the above factors into account, a typical spacing between the front roller nip and the closest surface of the bar is about ¼" to 7/16" in the case of cotton/polyester wrap/core, and about 1" to 2" with regard to wool/polyester wrap/core.

Referring again to FIG. 2 or 2*a*, groove 21 in bar 20 may be "v" shaped, rectangular, oval, circular, or any concave shape. Its width preferably should be slightly wider than the core strand diameter, i.e., about 1½ to 2 times the core strand diameter. The depth of the groove is about the same as the width, preferably about 75–150% of the groove width, depending upon groove shape. A flat (rectangular) groove may have a depth less than the width, while a "v" shaped groove may have a maximum depth greater than its maximum width.

Immediately after emergence from the front roller nip, the core and wrap strands tend to be flattened. However, the core strand tends to become cylindrical in cross-section as a result of being pulled into the groove 21 and as a result of some twist and tension being imparted thereto from downstream forces. These overall forces tend to condense and aggregate the core strand into a circular or oval cross-sectional shape.

As the strands emerge from the nip they are merged into a so-called sandwich in groove 21 with the core strand in the middle. One wrap strand lies below the core strand, and the other wrap roving lies above the core strand in the wrapping zone, as illustrated in the alternative embodiments of FIGS. 2 and 2*a*. The two wrap strands thereafter spirally wind around the core strand. 14. As shown in FIGS. 1–3, an "L" shaped yarn control guide 25, immediately downstream from and closely adjacent to bar 20, is screwed or otherwise attached to the bar. Guide 25 functions to prevent excessive yarn twist from flowing upstream past the guide.

In addition, guide 25 stabilizes the zone of contact between the fibers and bar 20. More specifically, as can be seen in FIG. 1*a* or 1*b*, the initial points of contact between the core strand and each of the two wrap strands do not coincide with one another. The wrap strand which initially contacts the core on the underside of the core ordinarily is the first contact point between strands, which is designated as point C in FIG. 3, while the other wrap strand "overwraps" at a second downstream contact point D. The arc CD is the wrap zone. Prior to initial contact between any of the fibers, all three strands first should come into contact with the surface of bar 20 along a common line upstream from point C, so that wrapping takes place on the bar 20, and not between the bar 20 and the front roller nip. This common line of contact, viewed on end as "A" in FIG. 3, is determined by the plane tangent to the upper roll of the front rollers 3 and the bar 20. Point B in FIG. 3 is the point of final contact of the wrapped yarn with the bar. This point is determined by the tangent from bar 20 to the surface of guide 25.

Arc AB in FIG. 3 defines the zone of direct contact between the fibrous strands and the bar. In operation, the wrapping zone CD should be stable and finite, and within AB, despite normal fluctuations in the overall nature of the contact between the fibrous strands and bar 20 during the dynamics of the spinning operation. Otherwise, there will be less than maximum coverage of the core strand by the wrap strands. In this context, about 30°–90° of arc measured along the core strand should remain in contact with bar 20 during operation.

Some factors which are taken into consideration in the positioning of guide 25 are as follows: As the pigtail guide 4 moves up and down with the ring rail 5 during winding of the product yarn, a positive deflection angle (FIG. 3, reference numeral 40) of the yarn from bar 20 around guide 25 to pigtail guide 4 (not shown in FIG. 3) should be maintained at all times. This deflection, however, should be as little as possible so as to avoid "trapping" too much twist, i.e., to avoid the situation where not enough twist flows upstream to maintain the integrity of the yarn or to perform the wrapping operation within the arc AB. This can be achieved by setting guide 25 so that is slightly deflects the path of the yarn from bar 20 to pigtail guide 4 when the pigtail and ring rail are at their lowest point in the package-building motion. For a typical cotton spinning frame a minimum deflection angle of about 10° to 15° is sufficient. The maximum deflection angle will occur when the pigtail guide and ring rail are at the maximum upward position, and typically will be about 9° greater than the initial (minimum) setting.

A simple way to provide for positioning of guide 25 is to fixedly secure it to bar 20 as by means of screws, and to mount the ends of bar 20 on the spinning frame in such a manner as to provide for rotational adjustment of the bar about its own axis (i.e., the bar is screwed at its axis to a bracket which in turn is fixed to the frame of the spinning system). In this arrangement, whenever the position of the bar is changed by loosening its axial screws and rotating the bar, guide 25 likewise is repositioned in a clockwise or coounterclockwise direction around the bar.

During the spinning operation, if too much twist begins to flow back upstream so that, for instance, wrap zone CD migrates upstream of line A resulting in a barber-pole yarn, then the guide 25 can be repositioned (clockwise around bar 20 in FIG. 3) to increase the minimum deflection angle and thereby increase frictional drag, trap more twist, and re-adjust the position of the wrap zone back within arc AB on bar 20. This adjustment can be performed conveniently during the spinning operation, if the guide 25 is attached to the bar 20 as described above, by rotating the bar slightly while observing the wrap zone CD, so as to cause CD to center well within arc AB.

It also is desirable to minimize the change in deflection as the pigtail guide moves. Thus, guide 25 should be as close to bar 20 as possible to minimize this variation. On the other hand, there should be sufficient clearance to permit easy piecing up. Generally, a distance of about ½ to ¾", between guide 25 and bar 20 will be sufficient for both these purposes. In an alternative embodiment, guide 25 may be spring-loaded against the surface or bar 20 so as to lightly grip the yarn passing between bar and guide.

In the preferred practice of the present invention, one continuous bar may accomodate several side-by-side spinning systems, as illustrated in FIG. 4, so that there is a single open channel or groove 21 adjacent each front roller pair in each of the spinning systems. The ends of the bar may be screwed into brackets 30 at the axis of the bar, which brackets in turn are secured to the overall frame 35 of the spinning systems.

With regard to the operational speeds of the system of the present invention, spindle speed may be the same as that employed to spin yarn of a given linear density and twist multiple, in the ordinary manner, from a roving having the same overall blend composition and combined linear density as the three rovings (two wrapper plus core). In this case, the same twist gear and draft gear ratio would be used, and the same linear density yarn produced. The three rovings creeled per position in the present invention would each have to be prepared with linear densities, on the average, ⅓ of the linear density of the conventional roving.

Alternatively, a separate approach would be to use three rovings, each having the same linear density as the comparable conventional single roving. In this case, however, the draft gear would be selected to increase the draft by a factor of three because three times as much roving (three rovings versus one roving) is pieced into the drafting zone. The same twist gear and spindle speed would produce the same yarn linear density and twist multiple as in the conventional single-roving case.

A third approach combines a change in linear density of the rovings with a change in draft gearing. One combination would be to reduce the roving linear densities by a factor of two, and increase the draft by a factor of 1.5. For instance, if a 1-hank roving is normally used with a draft of 28 to produce Ne 28 yarn in the conventional way, then three 2-hank rovings (one core and two wrapper rovings of different composition) may be used with a draft of 42 to produce Ne 28 core/wrap yarn by the present invention. Once again, the spindle speed and twist gear ratio of the machine would be the same, as would the resultant twist multiple of the yarn produced.

It will be obvious to those skilled in the art that many other practical combinations as to operational parameters exist. Variations in twist multiple, production rate, and yarn count may be accomplished by purely conventional manipulation of the textile relationships between the variables of roving linear density, spindle speed, twist and draft gearing, traveler weight, and so forth. In addition, basic ring spinning rules are to be considered. For instance, in cotton ring spinning, it is generally desirable to keep the draft below 50, and the roving count below three hank.

The following are general spinning parameters for a 28-tex, 67% cotton/33% polyester-staple-core yarn produced by the system of the present invention:

| | |
|---|---|
| polyester roving (1) = | 2-hank (1.5"; 1.2 denier; and 6 g/denier |
| cotton rovings (2) = | 2-hank (1 1/16" staple; Acala) each; |
| combined hank of roving = | 0.67 |
| total draft = | 42 |
| spindle speed (rpm) = | 9,100 |
| twist multiple = | 4.00 |
| traveller = | #6 (1.6 grains) |
| relative humidity = | 51 |
| temperature (C.) = | 20 |

The present invention may be employed to wrap fibrous materials around continuous filament core material such as continuous filament polyester, as well as around stable core material. When such continuous filament material is employed as the core strand, instead of being introduced into the drafting system through the back rolls, the filament core is fed into the drafting system immediately behind the front rollers and in alignment with groove 21 in bar 20. The operational speeds of the drafting zone and spindle are the same as for a similar system employing staple core material of the same linear density. The resulting product made from continuous polyester filament core strand and cotton wrap quite surprisingly has the same excellent strip resistance as core/wrap yarn having a staple core strand.

The present invention is able to produce a degree of wrap or sheath coverage never before attainable in the prior art. In this regard, the prior art procedure is best exemplified by U.S. Pat. No. 4,541,231. Fabrics made from continuous filament core/wrap yarn produced by said prior art procedure and other prior art procedures exhibit "glittering", which means that the core color is "showing through", because there are a substantial number of uncovered-core spots. In comparison, a visual inspection of the yarn of the present invention, and fabrics made therefrom, exhibit no such "glittering," and the core essentially is totally covered by the sheath.

Computer image analysis tests on random samples of continuous filament core/wrap yarns produced by the present invention and the best prior art, each sample having 10 centimeters of yarn, show that the yarn of the present invention provides over 99% sheath coverage (i.e., less than 1% of the core is uncovered or exposed), compared to no more than about 90% coverage or 10% exposed filament in the prior art. Thus, the present invention is able to provide less than 1/10 of the exposed filament attainable by the prior art.

The type of coverage achieved by the present invention significantly reduces, and may essentially eliminate, sheath strippage ("skin-back") during subsequent processing, e.g., weaving, knitting, or handling of the yarn, thereby enhancing yarn processability and quality of end product.

Another advantage achieved by the unusually high degree of sheath coverage is that, in the case of fiberglass continuous filament core/cotton wrap yarn, it significantly reduces fiber breakage (due to abrasion of exposed core material) and, consequently, shedding of the broken glass fragments. This helps to eliminate the problem of itching caused by the broken fragments and/or any broken individual filaments (in the exposed filament) in fabrics produced from prior art fiberglass continuous filament core/wrap yarns.

Still another advantage of the present invention is that it provides a greater degree of color and more suitability for chemical finishing for the finished fabric, because the unwanted presence of the continuous filament core on the yarn/fabric face, which most usually possesses a different degree of dyeability and chemical affinity or compatibility than the staple sheath, essentially is eliminated from the final fabric product. Also, the practically perfect core coverage provided by the invention in some cases with permit only dyeing of the wrap or sheath component, thus giving a significant cost advantage over the prior art wherein efforts must be made to dye both sheath and core.

In addition, the unusually high degree of sheath coverage achieved by the present invention can eliminate the type of snagging, pilling, or other similar defects occasionally caused by exposed or broken core filaments.

The core coverage achieved by the present invention also can provide significantly improved protection of the core from heat, in the case of sewing threads, protection from light in the case of light-sensitive core materials, and protection from electricity and chemical imbalance in the case of yarns used in special applications.

FIG. 5 is a photograph of a cross-section of the product of the present invention, in which the continuous filament core is polyester (individual strands are white circles in cross-section), and the sheath or wrap is cotton (individual strands are "amoeba-like" or dark blotches in cross-section). The total coverage of the wrap is quite evident. The product of the present invention exhibits such total coverage in cross-section essentially throughout the full length of the yarn.

The continuous filament core material used in the present invention ordinarily has an extension or elongation capacity of less than 20% without rupture, whether the material be fiberglass, polyester, polyethylene, nylon, and the like.

If the core material is highly stretchable (elastomeric) such that it can be extended or elongated at least 60% without breakage, then it is very important that the core be wrapped while it is in a partially stretched state. For example, if a particular core material has a rupture point at about 250–300% or even 300–500% elongation or extension, it is important that the core be stretched to at least 100% elongation at the point of wrapping. There will be partial contraction of the core material after wrapping, but the wrapped product nonetheless will remain in a substantially stretched state, after wrapping, during the entire processing and/or usage of the yarn. In other words,the wrapping prevents the core from returning to its completely unstretched state even in the absence of external tension on the wrapped yarn. Thus, in the practice of the present invention, any core material that is able to be stretched to, for example, 60% elongation without rupture, will be wrapped while it is in a stretched condition, and will remain in a substantially stretched condition, e.g., 20% or more elongation, when in its intended wrapped state.

As indicated above, the core/wrap product produced by the apparatus of the present invention possesses a strip resistance never before attainable with prior art core/wrap yarns. In the prior art, while it has been thought desirable to impart the desirable properties of staple fiber to stronger but less desirable continuous filament, strip-resistance of the resultant staple fiber wrap always has been a serious problem with the yarns. None of the prior art continuous filament core/stable fiber wrap yarns are strip resistant. Stripping and fuzz generation problems of the staple fiber wrap inherently occur during processing, e.g., winding, warping, knitting or weaving, of such prior art yarns.

The continuous filament core/staple fiber wrap yarns of the present invention are able to withstand the intensity of the severe strip resistance test hereinafter described. None of the prior art yarns of comparable linear density of this type of yarn are able to do so.

FIG. 6 illustrates the apparatus used in the test. The device is a Rothschild yarn friction tester that has been modified with a suitable knitting needle mounted in the path of the yarn. Reference numeral 100 designates yarn emanating from bobbin 102. The yarn passes around guide and tension device 104 to a second tension device 106, then to a tension sensor 108, through the eye of knitting needle 110, to a second tension sensor 112, to a take-up drum 114, and finally to a take-up reel 116. Speed of the yarn is controlled by a yarn speed device 120 that controls the speed of take-up drum 114.

The angle X formed by the yarn entering and exiting the eye of the knitting needle is about 10°. The knitting needle may range in size from 18 gauge to 54 gauge, in order to simulate the type of knitting needles ordinarily used in yarn processing. The needle is held stationary by means of a clamping device 122.

The device is operated at a speed and tension to simulate the speed, tension and abrasion typically encountered in yarn processing such as knitting or weaving. The yarns of the present invention are able to be passed through this machine at a speed of 300 meters per minute, at a tension of 0.5 grams per den (denier) linear density, and yet not exhibit any stripping or fuzz formation. In addition, despite the abrasion, the core of the resultant yarn remains essentially completely covered, i.e., over 99% staple fiber coverage, and thereby there are no "bare spots" of core.

On the other hand, a polyester-core/cotton-wrap yarn, 265 denier linear density, produced in the conventional way (e.g., by the apparatus of the present invention absent elements 20 and 25, while employing a single wrap roving), exhibited much minor stripping of the staple fiber wrap resulting in a fuzzy appearance after passing through the apparatus of FIG. 6 at the same operating conditions as above.

In another test, fiberglass-core/cotton-wrap yarn, 265 denier, produced conventionally, exhibited a major strip on the staple fiber wrap resulting in yarn breakage, and many minor strips resulting in a fuzzy appearance after passing through the machine of FIG. 6 at speed of 200 meters per minutes and tension of 60 grams.

In still another test, fiberglass-core/cotton-wrap yarn, 265 denier, produced conventionally, exhibited many minor strips of the staple fiber wrap resulting in a fuzzy appearance after passing through the machine of FIG. 6 at a speed of 120 metes per minute and tension of 40 grams.

In both latter tests, the stripping was severe enough to cause difficulty in mechanical processing and to produce an inferior, unsatisfactory product.

The following yarn linear densities and corresponding knitting needle sizes illustrate the densities of core/staple fiber wrap yarns of the present invention that are able to be tested with such needles as part of the above described test (FIG. 6), without causing strips or fuzz formation of the yarn, and without causing visible (to the naked eye) spots of core material to appear on the yarn: 1500–500 den yarn, 18-gage needle; 1000–300 den, 24-gage needle; 850–250 den, 36-gage needle; 550–150 den, 46-gage needle; 400–100 den, 54-gage needle.

No prior art core/staple fiber wrap yarns of the same linear densities and corresponding needle sizes are able to survive such a test without causing strips or fuzz formation. In other words, referring for example to the linear density range 1500–500 den: any prior art core/wrap yarns having such a linear density will have noticeable strips and fuzz if tested with an 18-gage needle at the parameters set forth above. In addition, the test usually will create discernible visible spots of core material on the prior art yarn.

A further embodiment of the present invention is shown in FIGS. 7 and 8. In the system according to this embodiment, an end portion 138 of the bar 220 is mounted to a first end of a bar 140 and the other end of the bar 220 includes a conical tip 142. The bar 220 is tapered so that the diameter of the portion 138 of the bar 220 is greater than the diameter of a portion 146 of the bar 220 which is adjacent to the groove 21. The tapered portion 146 is preferably ¼ of an inch to 1/16 of an inch wide. In addition, the diameter of a portion 144 of the bar 220 which is adjacent to the conical tip 142 is greater than the diameter of the portion 146 of the bar 220. The diameter of the portions 138 and 144 of the bar 220 are preferably at least ¼ inch greater than the diameter of the portion 146 of the bar 220. Those skilled in the art will recognize that the cross-section of the bar 220 of this embodiment may also be semi-circular in order to achieve the proper clearance between the bar 220 and the draft rollers 3.

The yarn control guide 25 is movably coupled within a slot 152 formed in an intermediate portion of the bar 140 by means of a pin 154 and a second end of the bar 140 is rotatably coupled to a frame 148 of the spinning machine via a bolt 150. Thus the yarn guide 25 may be rotated about the bar 220 by moving the pin 154 within the slot 152. The operative position of the bar 140 as shown in FIG. 7 and, consequently, the operative position of the bar 220 and the yarn guide 25, is limited by a stop pin 156 which projects from the frame 148 and prevents rotation of the bar 140 beyond the desired operative position. A spring 160 coupled between the bar 140 and the frame 148, is biased to maintain the bar 140 in the operative position abutting the stop pin 156. In the operative position, the bar 220 and the yarn guide 25 are preferably positioned as described in regard to the previous embodiments. The yarn guide 25 may be moved within the slot 152 so that a desired angular orientation, with respect to the bar 220, may be obtained.

In operation, the spinning machine according to this embodiment functions substantially similarly to the spinning machines of the previously described embodiments except that, as the wrap roving 9 and 10 and the core roving 12 leave the front draft rollers 3, they contact the bar 220 along the tapered surface and are drawn into the groove 21. The spinning machine according to this embodiment also improves the piecing-up operation. When the yarn breaks, the operator swings the bar 140 and, consequently, the bar 220 and the yarn guide 25 out of the operative position into the piecing-up position shown in FIG. 8. Those skilled in the art will understand that the apparatus can include any known means for locking the bar 140 in the piecing-up position while the piecing-up operation is performed. This allows the operator to perform a "conventional" piecing-up operation. Specifically, while the bar 140 is in the piecing-up position and the bar 220 and the yarn guide 25 are out of the vicinity of the forward rollers 3, the piecing-up operation may be carried out in front of the rollers allowing a fiber overlap of ¼ inch or less. When the piece-up operation is complete, the operator removes the bar 140 from the piecing-up position and allows the bias of the spring 160 to it to return it to the operative position. As the bar 220 approaches the yarn, the conical tip 142 moves beneath the yarn and the yarn slides across the surface of the conical tip 142 and down the tapered surface of the bar 220 into the groove 21. Those skilled in the art will recognize that any properly angled surface will allow the forward end of the bar 220 to pass beneath the yarn so that the yarn is smoothly guided to the groove 21 and that this tip need not be conical.

In contrast, the proximity of the bar 220 to the forward roller in the previous embodiments required the operator to piece-up by feeding the yarn from behind the forward rollers. This technique results in a fiber overlap of 2 inches or more and is slightly more time consuming than the "conventional" operation.

Those skilled in the art will understand that the geometry of the groove 21 may be configured in the system accoding to this embodiment as described in regard to the previous embodiments. In addition, the bar 220 according to this embodiment may be longitudinally cut in half to form a semicircular cross-section as described in regard to the previous embodiments.

Thus, in summary, prior art core/staple fiber wrap yarns of 1500–100 den are unable to pass the above test with such needles.

We claim:

1. A ring spinning device for forming core/wrap yarn comprising:

a frame;

a pair of draft rollers coupled to the frame so that a nip is formed between the draft rollers;

a strand feeding apparatus for feeding a core strand, a first wrap strand and a second wrap strand to the nip, wherein the first wrap strand enters the nip on one side of the core strand and the second wrap strand enters the nip on the side of the core strand opposite the first wrap strand;

a curved support surface including an open channel extending substantially perpendicularly to the nip, wherein the support surface is coupled to the frame so that the open channel may be moved from a first operative position immediately downstream of the nip to a second non-operative position not immediately downstream of the nip, spaced from the first operative position, wherein the first and second wrap strands are wrapped around the core strand while supported within the channel;

a wind-up spindle;

a yarn guide coupled to the frame downstream of the support surface for guiding the wrapped yarn to the wind-up spindle.

2. A ring spinning device according to claim 1, wherein the support surface is rotatably coupled to the frame.

3. A ring spinning device according to claim 2, wherein the support surface extends from a first end coupled to the frame across the channel to a second end, and wherein the second end of the support surface forms a point so that, when the support surface is rotated into the path of the yarn, the yarn is smoothly engaged by the support surface and slides into the channel.

4. A ring spinning device according to claim 2, wherein the support surface extends from a first end coupled to the frame across the channel to an outer portion and then extends to a second end, the curved support surface defining a cross-section which includes at least a portion of a substantially circular curve and wherein a first portion of the support surface is tapered so that the diameter of the substantially circular cross-section decreases gradually from the first end to the channel and increases gradually from the channel to the outer portion.

5. A ring spinning device according to claim 4, wherein the second end of the support surface forms a point so that, when the support surface is rotated from the second position into the path of the yarn, the yarn is smoothly engaged by the second end of the support surface and slides along the tapered first portion of the support surface into the channel.

6. A ring spinning device according to claim 5, wherein the second end of the support surface is conical.

7. A ring spinning device according to claim 4, wherein the diameter of the substantially circular curve at the first end and at the outer portion of the support surface is 1/16 inch greater than the diameter of the substantially circular curve adjacent to the channel.

8. A ring spinning device according to claim 2, further including a spring biased on maintain the open channel in the operative position.

9. A ring spinning device according to claim 1, wherein the yarn guide is coupled to the frame so that the angular orientation of the yarn guide, relative to the support surface, may be altered.

10. A ring spinning device according to claim 9, wherein the yarn guide may be rotated about the support surface.

11. A ring spinning device according to claim 9, wherein the yarn guide is coupled to the frame so that, when the support surface is moved from the operative position to the second position, the yarn guide is moved out of the path of the yarn and, when the support surface is moved from the second position into the operative position, the yarn guide is moved back into the path of the yarn.

* * * * *